US006955260B1

(12) United States Patent
Gaillard

(10) Patent No.: US 6,955,260 B1
(45) Date of Patent: Oct. 18, 2005

(54) PORTABLE SALON STATION SYSTEM

(76) Inventor: Bruce B. Gaillard, 4599 Reesewood Ct., Columbus, GA (US) 31907

( * ) Notice: Subject to any disclaimer, the term of this patent is extended or adjusted under 35 U.S.C. 154(b) by 0 days.

(21) Appl. No.: 10/668,791

(22) Filed: Sep. 22, 2003

(51) Int. Cl.[7] ..... B65D 85/28
(52) U.S. Cl. ..... 206/373; 219/242
(58) Field of Search ..... 206/349, 372, 206/373, 379; 132/314, 315; 219/222, 225, 219/242; 312/902; 280/47.26, 47.28

(56) References Cited

U.S. PATENT DOCUMENTS 3,074,539 A * 1/1963 Rogovin ..... 206/379
3,541,302 A * 11/1970 Makino ..... 219/242
3,713,529 A * 1/1973 Meksula ..... 206/373
5,054,615 A * 10/1991 Stillwagon et al. ..... 206/373
5,749,379 A * 5/1998 Stillwagon et al. ..... 219/242
5,875,794 A * 3/1999 Ekman ..... 206/373
6,109,446 A * 8/2000 Foote ..... 219/242
6,294,759 B1 * 9/2001 Dunn, Jr. ..... 206/373

* cited by examiner

*Primary Examiner*—Luan K. Bui

(57) ABSTRACT

A portable salon station system for efficiently and safely transporting salon appliances. The portable salon station system includes a base, a cover removably attached to the base, a support member pivotally attached to the base, a guide member having a guide slot that slidably receives a pin extending from the support member, and a plurality of holder members attached to the support member for receiving a curling iron. The guide slot has an upper catch portion that allows for the support member to be fully extended in an upright position for normal usage. The support member may be lowered into the base into a compact storage position for allowing attachment of the cover to the base. A transporting structure removably receives the combination base and cover for allowing efficient transportation thereof.

20 Claims, 9 Drawing Sheets

PORTABLE SALON STATION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to salon storage devices and more specifically it relates to a portable salon station system for efficiently and safely transporting salon appliances.

2. Description of the Related Art

Salon storage devices have been in use for years. More particularly, conventional storage cases for independent salon appliances have been used to store and transport the respective salon appliances. Hair professionals often times must transport their salon appliances from one workstation to another. In addition, hair professionals sometimes must transport their salon appliances to a client's residence or other remote location.

However, conventional salon storage devices are not suitable for usage where a plurality of salon appliances are being transported (e.g. curling irons, curling iron oven). The main problem with conventional storage devices is that they do not allow for the simultaneous storage and transportation of a plurality of items. A further problem is that conventional storage devices are prone to heat damage from the salon appliances since the salon appliances retain a significant amount of heat after usage thereof. A further problem with conventional storage devices is that they require the user to manually lift the appliances which can be physically demanding over extended distances.

On attempted solution to conventional salon storage devices is illustrated in U.S. Pat. No. 5,054,615 to Stillwagon. The '615 patent illustrates the usage of a stationary band supporting a plurality of tubular receptacles for receiving hair irons. However, the '615 patent does not illustrate a foldable compact structure that is suitable for transporting. In addition, the '615 patent does not illustrate a transporting structure for easily transporting the case structure. There are other limitations within the '615 patent which the present invention addresses.

While these devices may be suitable for the particular purpose to which they address, they are not as suitable for efficiently and safely transporting salon appliances. Conventional storage devices are not suitable for storing and transporting a plurality of salon appliances over extended distances.

In these respects, the portable salon station system according to the present invention substantially departs from the conventional concepts and designs of the prior art, and in so doing provides an apparatus primarily developed for the purpose of efficiently and safely transporting salon appliances.

BRIEF SUMMARY OF THE INVENTION

In view of the foregoing disadvantages inherent in the known types of salon storage devices now present in the prior art, the present invention provides a new portable salon station system construction wherein the same can be utilized for efficiently and safely transporting salon appliances.

The general purpose of the present invention, which will be described subsequently in greater detail, is to provide a new portable salon station system that has many of the advantages of the salon storage devices mentioned heretofore and many novel features that result in a new portable salon station system which is not anticipated, rendered obvious, suggested, or even implied by any of the prior art salon storage devices, either alone or in any combination thereof.

To attain this, the present invention generally comprises a base, a cover removably attached to the base, a support member pivotally attached to the base, a guide member having a guide slot that slidably receives a pin extending from the support member, and a plurality of holder members attached to the support member for receiving a curling iron. The guide slot has an upper catch portion that allows for the support member to be fully extended in an upright position for normal usage. The support member may be lowered into the base into a compact storage position for allowing attachment of the cover to the base. A transporting structure removably receives the combination base and cover for allowing efficient transportation thereof.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a portable salon station system that will overcome the shortcomings of the prior art devices.

A second object is to provide a portable salon station system for efficiently and safely transporting salon appliances.

Another object is to provide a portable salon station system that is capable of storing various types of salon appliances such as curling irons, an oven and the like.

An additional object is to provide a portable salon station system that is compact in structure.

A further object is to provide a portable salon station system that has a removable transportation structure.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
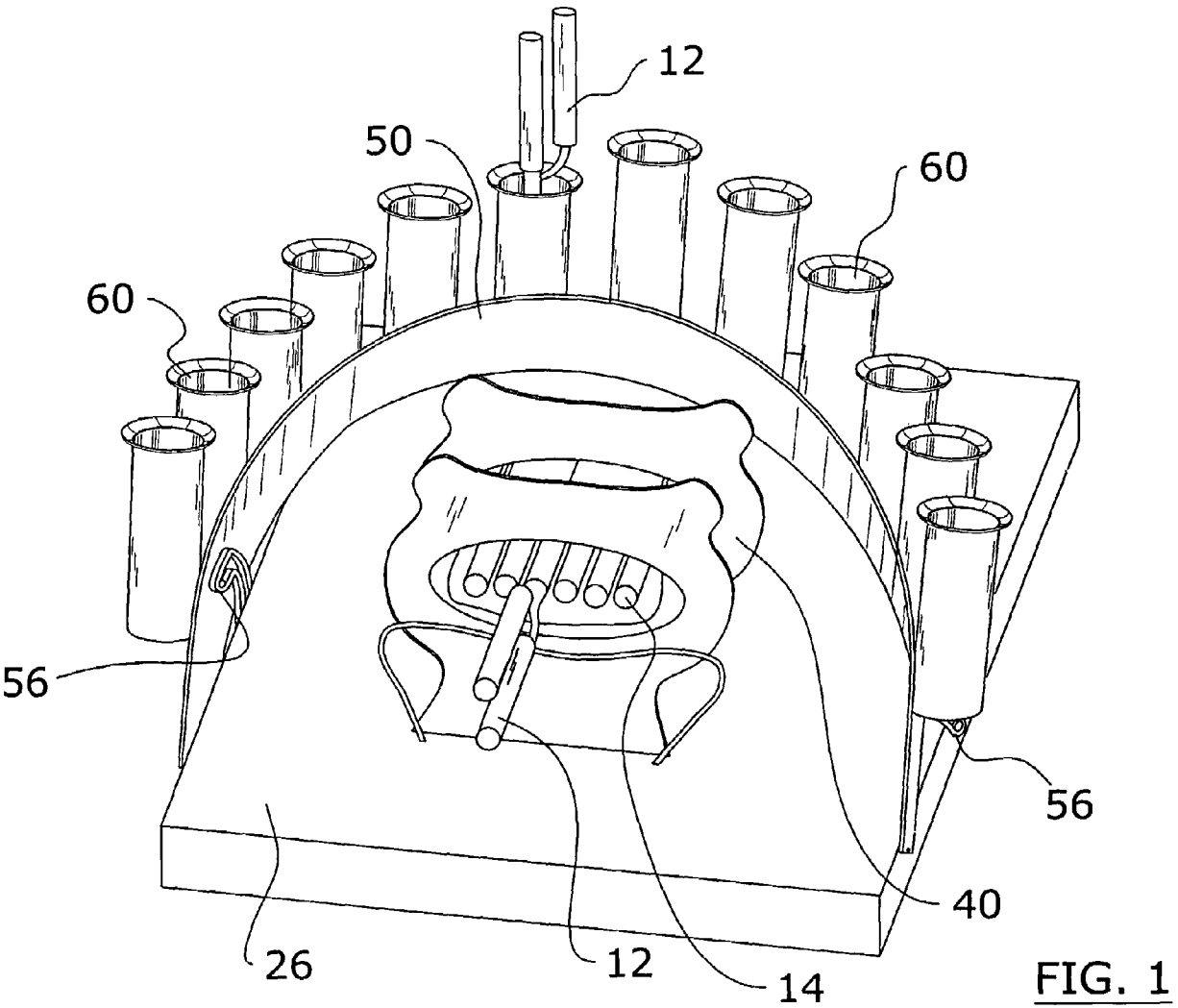
FIG. 1 is an upper perspective view of the present invention.

Turning now descriptively to the drawings, in which similar reference characters denote similar elements throughout the several views, FIGS. 1 through 9 illustrate a portable salon station system 10, which comprises a base 20, a cover 30 removably attached to the base 20, a support member 50 pivotally attached to the base 20, a guide member 56 having a guide slot that slidably receives a pin extending from the support member 50, and a plurality of holder members 60 attached to the support member 50 for receiving a curling iron 12. The guide slot has an upper catch portion that allows for the support member 50 to be fully extended in an upright position for normal usage. The support member 50 may be lowered into the base 20 into a compact storage position for allowing attachment of the cover 30 to the base 20. A transporting structure 70 removably receives the combination base 20 and cover 30 for allowing efficient transportation thereof.

B. Enclosure

Figure 2:
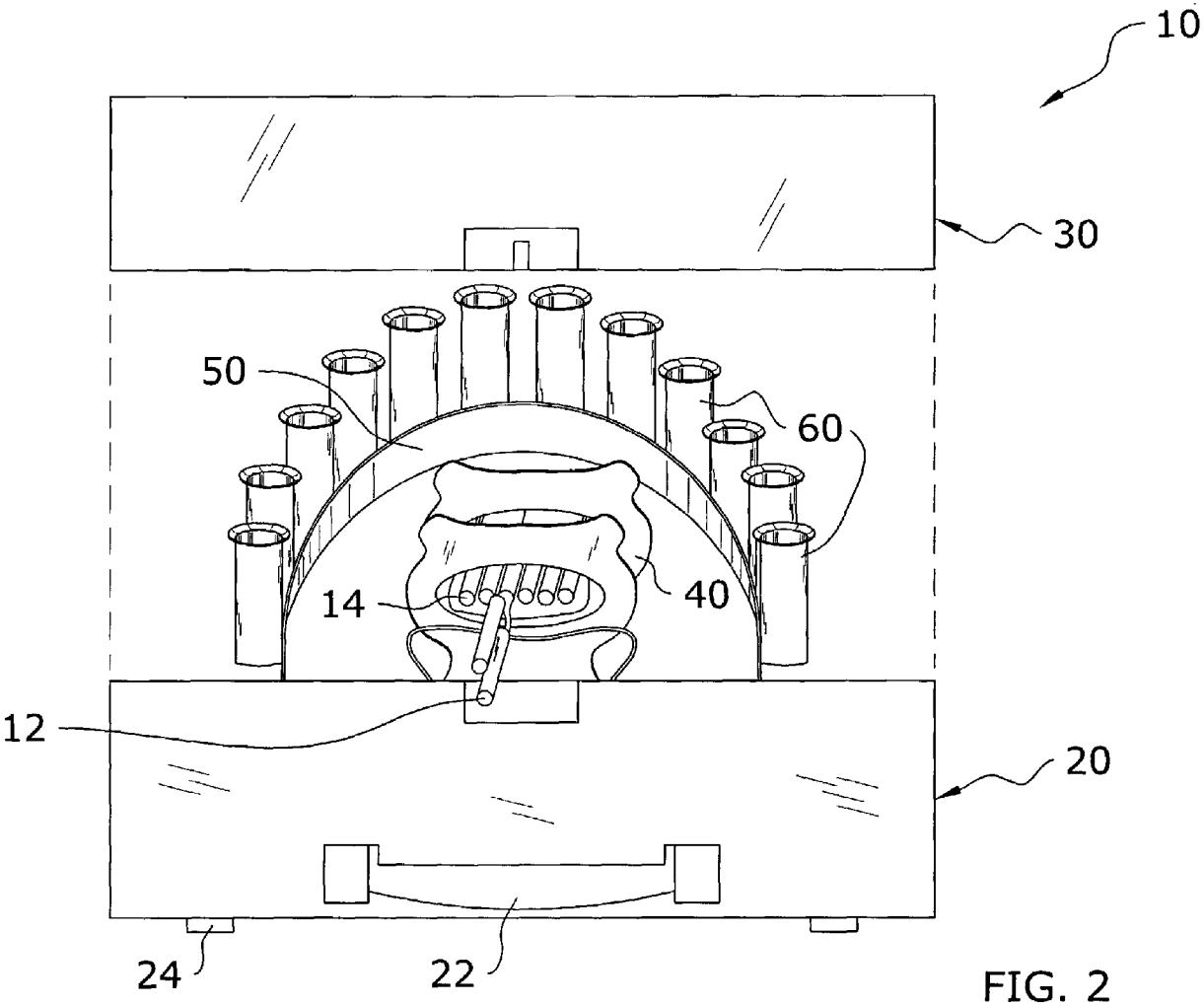
FIG. 2 is an exploded front view of the present invention.

The enclosure is comprised of a base 20 and a cover 30 as best shown in FIG. 2 of the drawings. The cover 30 is removably connectable to the base 20 for providing access to the salon accessories and appliances (e.g. curling iron 12, etc.) within. The cover 30 may be pivotally attached to the base 20 or completely removably attached to the base 20. Various securing structures may be utilized to secure the cover 30 to the base 20 as can be appreciated.

The enclosure preferably has a rectangular structure, however various other structures may be utilized to construct the enclosure. The base 20 and the cover 30 have a heat resistant inner liner to prevent damage to the enclosure from heated salon appliances and accessories.

At least one handle 22 is preferably attached to the enclosure for allowing easy grasping by a user. The base 20 preferably includes a plurality of feet 24 extending from a lower surface for supporting the base 20 upon a surface.

A support platform 26 or similar structure is attached within the base 20. The support member 50 and the guide member 56 are pivotally connected to the support platform 26 as best shown in FIG. 1 of the drawings.

C. Support Member

The support member 50 is pivotally attached within the base 20 at a pivot point 54 as shown in FIG. 1 of the drawings. The support member 50 may have various structures and shapes capable of supporting the plurality of holder members 60. FIGS. 1 and 2 illustrate an exemplary support member 50, however various other structures may be utilized to construct the support member 50.

D. Holder Members

A plurality of holder members 60 are attached to the support member 50 as shown in FIGS. 1 through 5 of the drawings. The holder members 60 each have a tubular structure with an upper opening as shown in FIGS. 1 and 2 of the drawings. The holder members 60 are formed for receiving at least one curling iron 12 per holder member 60. The holder members 60 are preferably substantially vertical when the support member 50 is positioned in an upright position as shown in FIG. 3*a* of the drawings.

The holder members 60 are preferably comprised of a heat resistant material such as but not limited to metal for receiving a heated salon appliance. Various other structures may be utilized to support the curling iron 12 and other salon appliances such as but not limited to hooks, loops and the like.

E. Guide Member

A guide member 56 is pivotally attached to the base 20. The guide member 56 is preferably attached to the support platform 26 as illustrated in FIGS. 1, 3*a* through 5 of the drawings. The guide member 56 includes a guide slot that slidably receives a flanged pin extending from the support member 50.

Figure 3A:
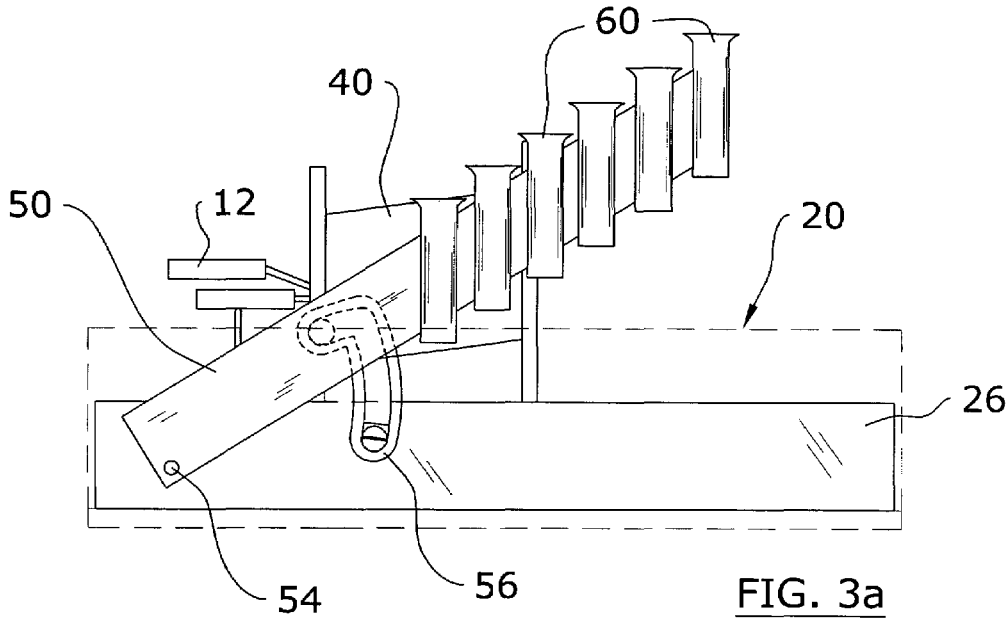
FIG. 3*a* is a side view of the present invention with the support member fully extended in the usage position.

As shown in FIGS. 3*a* through 5 of the drawings, the guide slot is curved to correspond to the radius of curvature of the support member 50. The guide slot has an upper catch portion extending along the radius of movement of the guide member 56 as shown in FIGS. 3*a* through 5 of the drawings. The upper catch portion selectively catches the pin to retain the support member 50 in an upright position as shown in FIG. 3*a* of the drawings.

F. Oven

An oven 40 is preferably positioned within the base 20 as shown in FIGS. 2 through 5 of the drawings. The oven 40 may be comprised of any convention oven 40 commonly utilized to heat the contact element 14 of the curling irons 12.

G. Transporting Structure

A transporting structure 70 is preferably provided that allows for the transportation of the enclosure when fully closed. The transporting structure 70 preferably removably receives the enclosure as shown in FIGS. 6 through 9 of the drawings.

The transporting structure 70 has a frame structure. The frame structure may be comprised of a plurality of support poles 72 or related frame structure attached to a plurality of wheels 74 as shown in FIGS. 6 through 9 of the drawings. A handle may be attached to the support poles 72 as best shown in FIG. 9 of the drawings.

Figure 6:
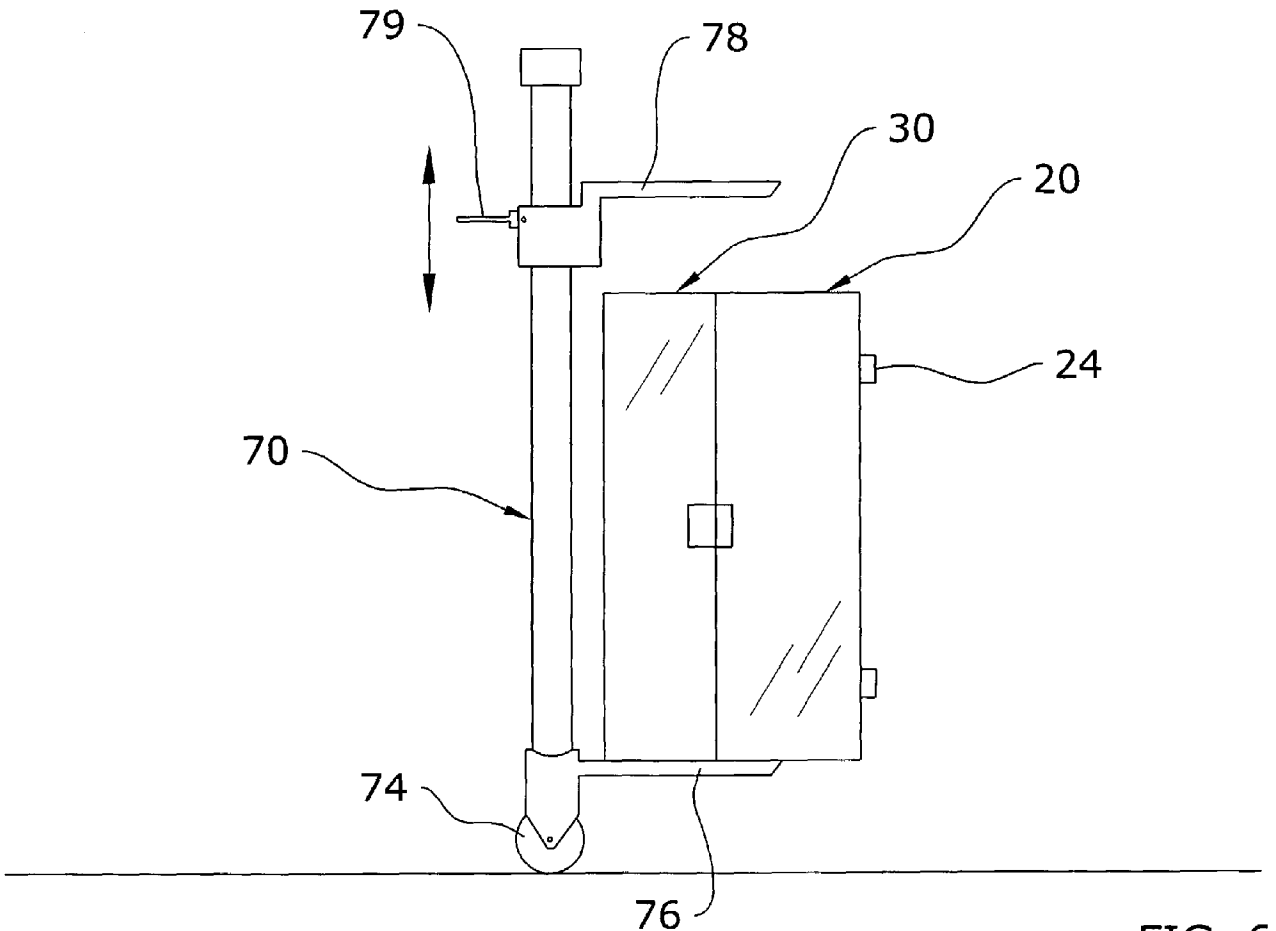
FIG. 6 is a side view of the transporting structure receiving the case structure.
Figure 7:
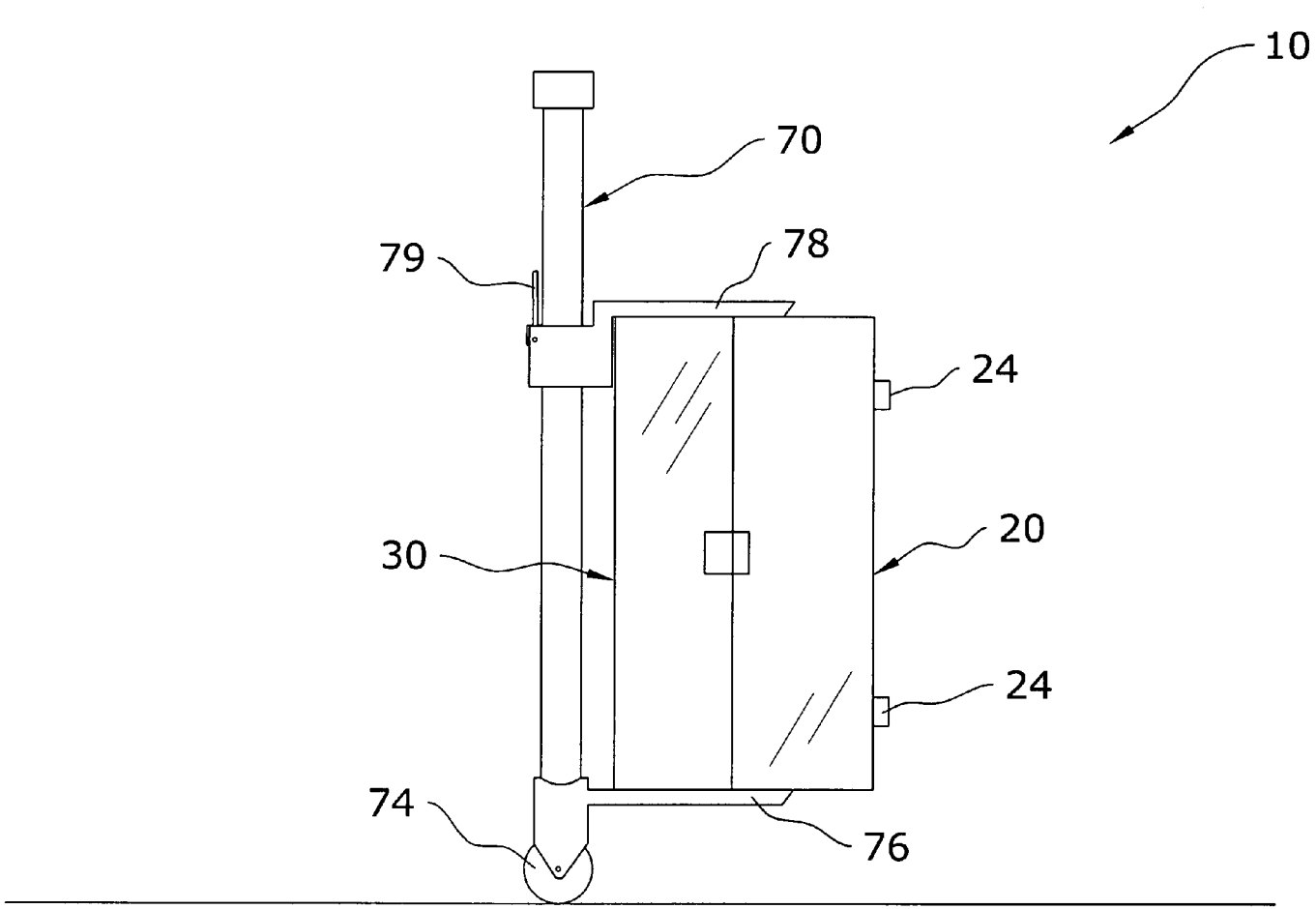
FIG. 7 is a side view of the transporting structure with the upper bracket retained against the case structure.
Figure 8:
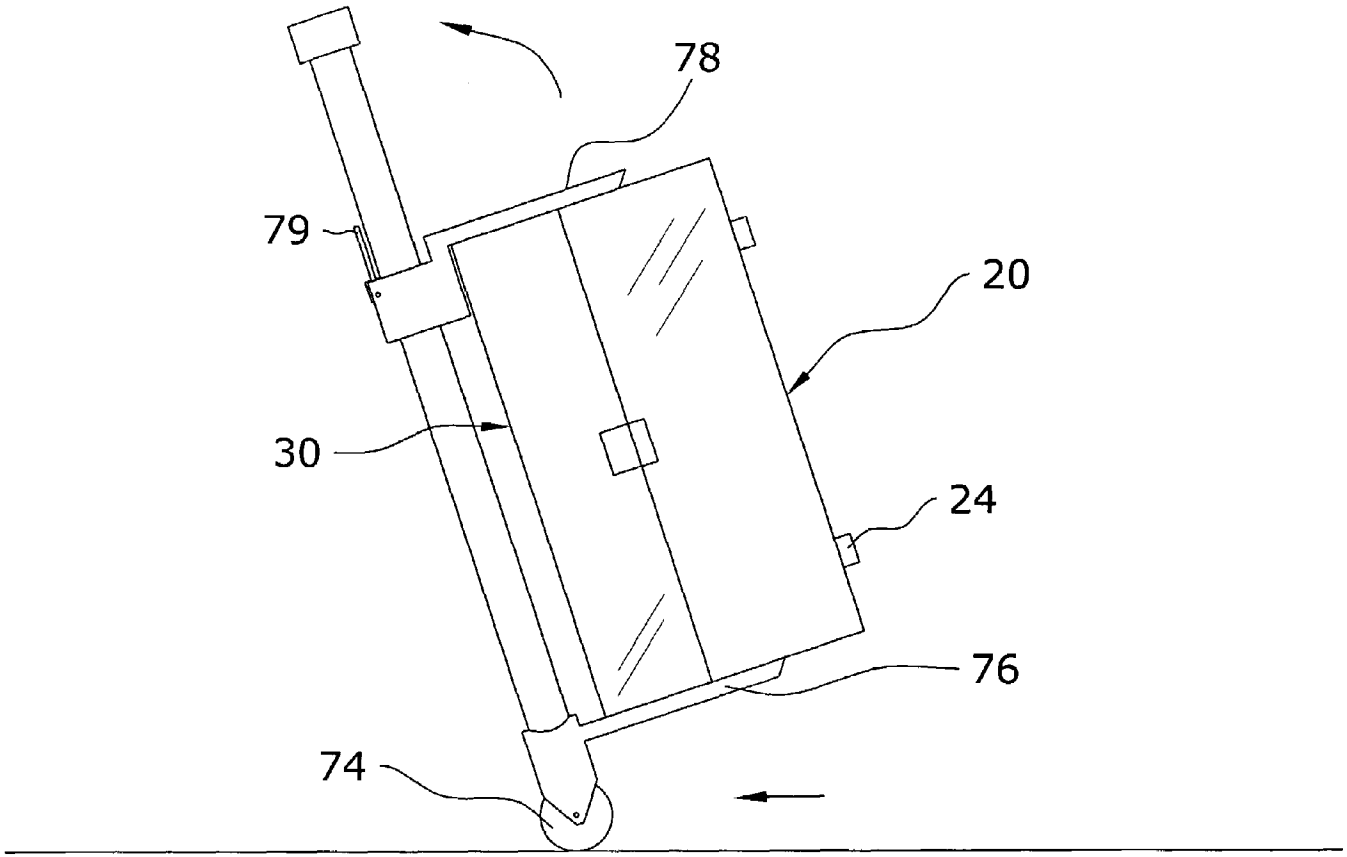
FIG. 8 is a side view of the transporting structure pivoted and moving forwardly.
Figure 9:
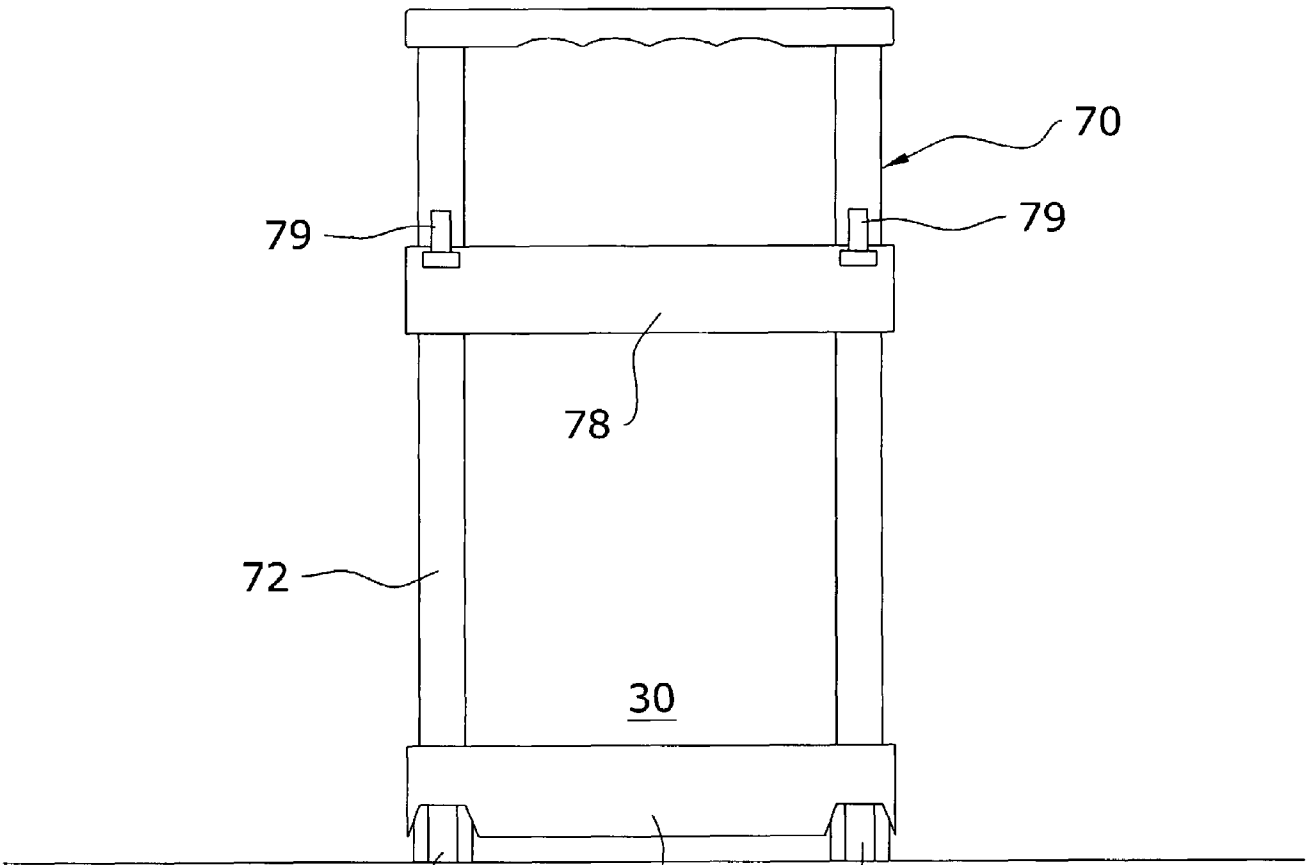
FIG. 9 is a rear view of the transporting structure with the case structure attached within.

A lower support 76 is attached to and extends from a lower portion of the support poles 72 in a non-movable manner as shown in FIGS. 6 through 8 of the drawings. The lower support 76 may have various broad structures capable of supporting the enclosure.

An upper support 78 is slidably attached to and extends from an upper portion of the support poles 72 as shown in FIGS. 6 through 8 of the drawings. A locking lever 79 or similar locking mechanism is positioned within the upper support 78 for selectively locking a desired position of the upper support 78 as shown in FIG. 7 of the drawings.

H. Operation

The user utilizes the transporting structure 70 to transport the enclosure to a desired location. The user releases the locking lever 79 of the upper support 78 and elevates the upper support 78 away from the enclosure. The user then removes the enclosure from the transporting structure 70. The user positions the enclosure on a desired surface such as a table or stand. The cover 30 is then removed from the base 20 thereby exposing the curling irons 12 and related salon items as shown in FIG. 2 of the drawings.

Figure 3B:
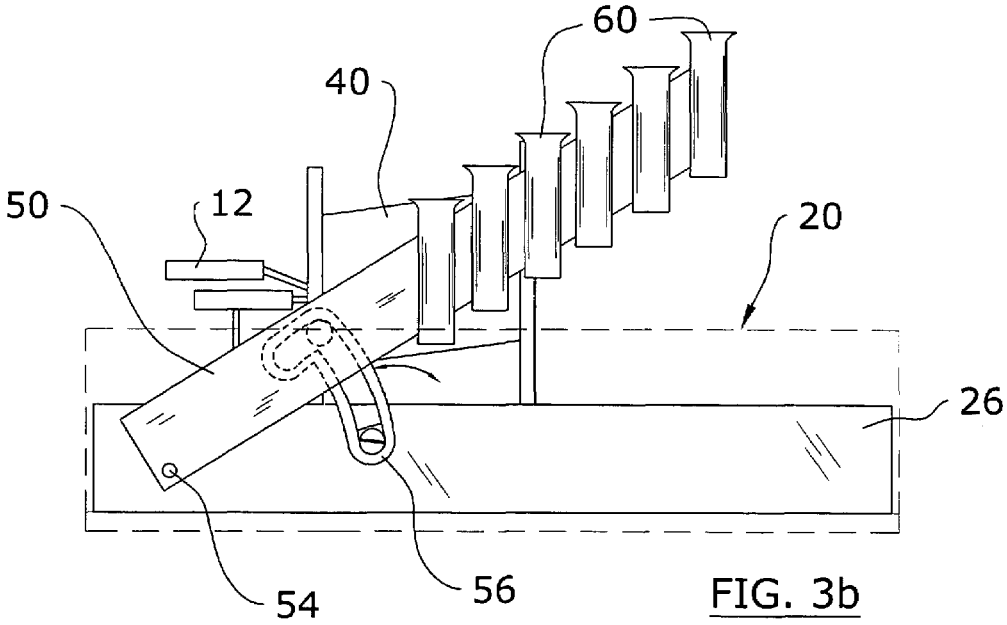
FIG. 3*b* is a side view of the present invention with the support member fully extended with the guide member pivoted from the locked position.
Figure 4:
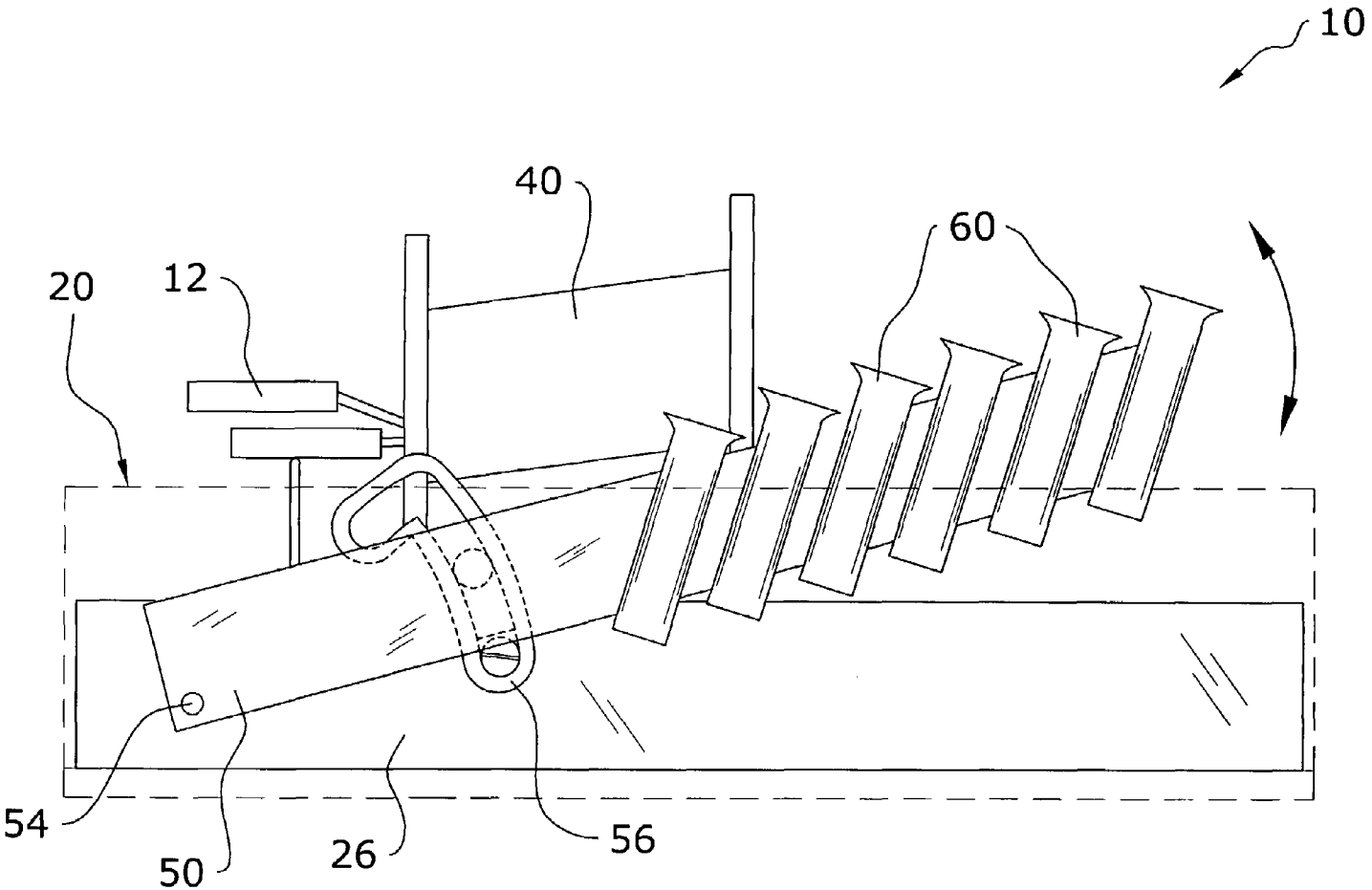
FIG. 4 is a side view of the present invention with the support member partially extended.
Figure 5:
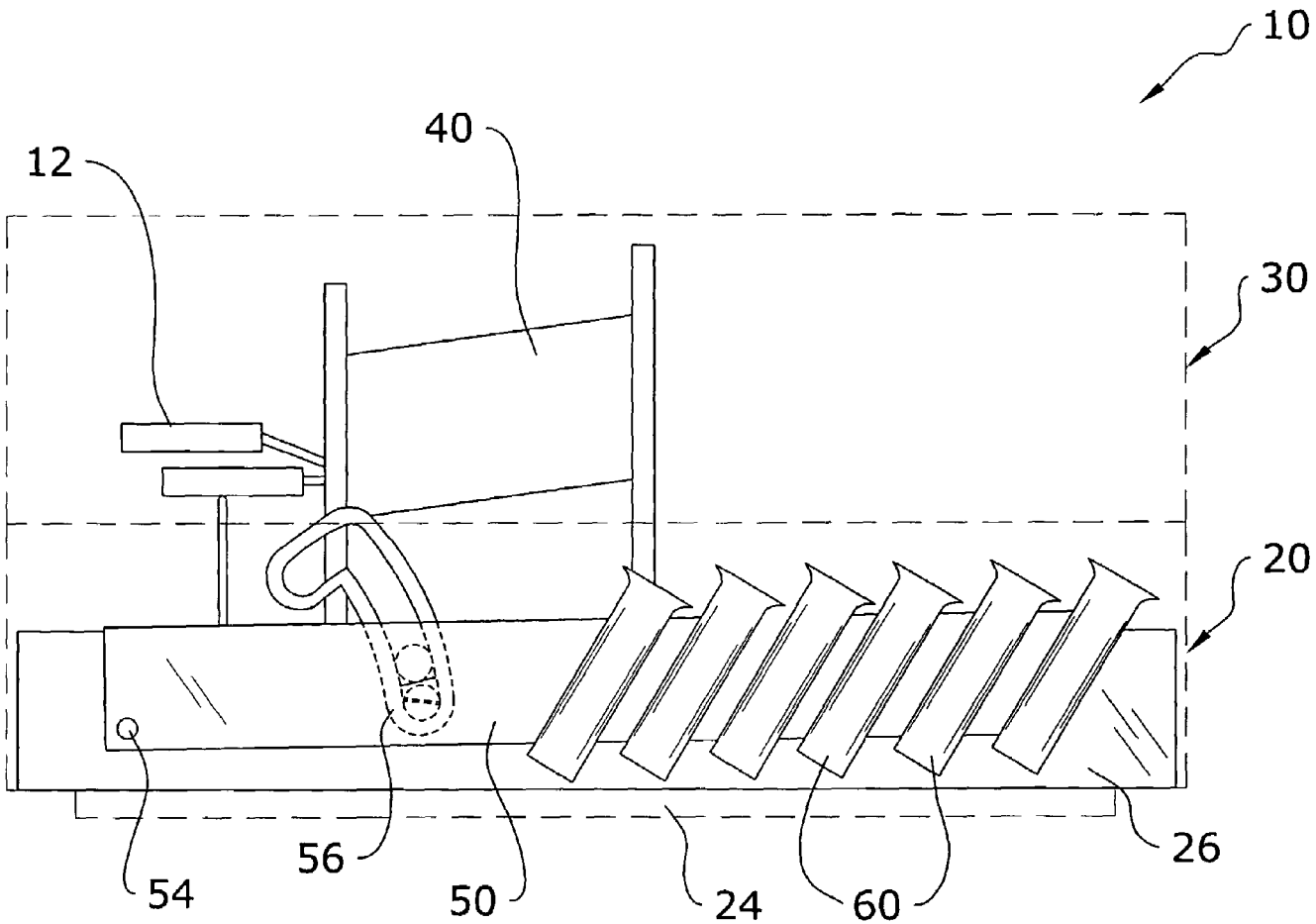
FIG. 5 is a side view of the present invention with the support member fully retracted into the storage position.

The user then elevates the support member 50 as shown in FIG. 4 of the drawings from the storage position (illustrated in FIG. 5 of the drawings). The user continues to elevate the support member 50 until the pin from the support member 50 has reached the upper portion of the guide slot within the guide member 56 as shown in FIG. 3*b* of the drawings. The user then pivots the guide member 56 forwardly so that the pin is positioned within the catch portion of the guide slot as shown in FIG. 3*a* of the drawings. The support member 50 is now fully supported by the guide member 56 as shown in FIG. 3*a* of the drawings. The user is then able to access the curling irons 12 from the oven 40 as needed. Heated curling irons 12 may be positioned within the holder members 60 to allow for cooling and storage thereof. When finished, the above process is simply reversed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable salon station system, comprising:

an enclosure comprised of a base and a cover, wherein said cover is removably connectable to said base;

a support platform attached within said base;

a support member pivotally attached to said support platform at a pivot point;

a plurality of holder members attached to said support member;

a guide member pivotally attached to said support platform; and a guide slot within said guide member that slidably receives a pin extending from said support member.

2. The portable salon station system of claim 1, wherein said base and said cover have a heat resistant inner liner.

3. The portable salon station system of claim 1, including a handle attached to said enclosure.

4. The portable salon station system of claim 1, wherein said guide slot is curved.

5. The portable salon station system of claim 4, wherein said guide slot has an upper catch portion extending along the radius of movement of said guide member, wherein said upper catch portion selectively catches said pin to retain said support member in an upright position.

6. The portable salon station system of claim 1, wherein said base includes a plurality of feet.

7. The portable salon station system of claim 1, wherein said holder members have a tubular structure.

8. The portable salon station system of claim 7, wherein said holder members are substantially vertical when said support member is positioned in an upright position.

9. A portable salon station system, comprising:

an enclosure comprised of a base and a cover, wherein said cover is removably connectable to said base;

a transporting structure having a plurality of wheels, wherein said transporting structure removably receives said enclosure;

a support member pivotally attached within said base at a pivot point;

a plurality of holder members attached to said support member;

a guide member pivotally attached within said base;

a guide slot within said guide member that slidably receives a pin extending from said support member;

wherein said base and said cover have a heat resistant inner liner;

a handle attached to said enclosure;

a support platform attached within said base that said support member and said guide member are pivotally connected to;

wherein said guide slot is curved;

wherein said guide slot has an upper catch portion extending along the radius of movement of said guide member, wherein said upper catch portion selectively catches said pin to retain said support member in an upright position;

wherein said base includes a plurality of feet;

wherein said holder members have a tubular structure;

wherein said holder members are substantially vertical when said support member is positioned in an upright position;

wherein said transporting structure is comprised of:

a plurality of support poles attached to said wheels;

a lower support attached to and extending from a lower portion of said support poles in a non-movable manner;

an upper support slidably attached to and extending from an upper portion of said support poles; and a locking lever within said upper support for selectively locking a position of said upper support.

10. A portable salon station system, comprising:

an enclosure comprised of a base and a cover, wherein said cover is removably connectable to said base;

a transporting structure having a plurality of wheels, wherein said transporting structure removably receives said enclosure;

a support platform attached within said base;

a support member pivotally attached to said support platform at a pivot point;

a plurality of holder members attached to said support member;

a guide member pivotally attached to said support platform; and a guide slot within said guide member that slidably receives a pin extending from said support member.

11. The portable salon station system of claim 10, wherein said base and said cover have a heat resistant inner liner.

12. The portable salon station system of claim 10, including a handle attached to said enclosure.

13. The portable salon station system of claim 10, wherein said guide slot is curved.

14. The portable salon station system of claim 13, wherein said guide slot has an upper catch portion extending along the radius of movement of said guide member, wherein said upper catch portion selectively catches said pin to retain said support member in an upright position.

15. The portable salon station system of claim 10, wherein said base includes a plurality of feet.

16. The portable salon station system of claim 10, wherein said holder members have a tubular structure.

17. The portable salon station system of claim 16, wherein said holder members are substantially vertical when said support member is positioned in an upright position.

18. The portable salon station system of claim 10, wherein said transporting structure is comprised of:

a plurality of support poles attached to said wheels;

a lower support attached to and extending from a lower portion of said support poles in a non-movable manner;

an upper support slidably attached to and extending from an upper portion of said support poles; and a locking lever within said upper support for selectively locking a position of said upper support.

19. A portable salon station system, comprising:

an enclosure comprised of a base and a cover, wherein said cover is removably connectable to said base;

a support member pivotally attached within said base at a pivot point;

a plurality of holder members attached to said support member;

a guide member pivotally attached within said base; and a guide slot within said guide member that slidably receives a pin extending from said support member, wherein said guide slot is curved, and wherein said guide slot has a main portion and an upper catch portion extending substantially transversely with respect to said main portion, wherein said upper catch portion selectively catches said pin to retain said support member in an upright position.

20. The portable salon station system of claim 19, wherein said holder members are substantially vertical when said support member is positioned in an upright position.

* * * * *